US007645955B2

(12) United States Patent
Huang et al.

(10) Patent No.: US 7,645,955 B2
(45) Date of Patent: Jan. 12, 2010

(54) METALLIC LINKAGE-TYPE KEYING DEVICE

(75) Inventors: Yu-Cheng Huang, Hsinchu (TW); Tzn-Chih Lin, Hsinchu (TW)

(73) Assignee: Altek Corporation, Hsinchu (TW)

( * ) Notice: Subject to any disclaimer, the term of this patent is extended or adjusted under 35 U.S.C. 154(b) by 699 days.

(21) Appl. No.: 11/498,236

(22) Filed: Aug. 3, 2006

(65) Prior Publication Data

US 2008/0064321 A1 Mar. 13, 2008

(51) Int. Cl.
*H01H 3/12* (2006.01)

(52) U.S. Cl. ..... 200/341; 200/5 A

(58) Field of Classification Search ..... 200/5 A, 200/512–520, 310–314, 341–345
See application file for complete search history.

(56) References Cited

U.S. PATENT DOCUMENTS 6,914,203 B2 * 7/2005 Suzuki ..... 200/6 A
7,005,588 B2 * 2/2006 Pihlaja ..... 200/5 A
7,145,087 B1 * 12/2006 Su et al. ..... 200/4
7,288,732 B2 * 10/2007 Hashida ..... 200/5 A

* cited by examiner

*Primary Examiner*—Michael A Friedhofer
*Assistant Examiner*—Lisa N Klaus
(74) *Attorney, Agent, or Firm*—Rosenberg, Klein & Lee

(57) ABSTRACT

The present invention discloses a metallic linkage-type keying device, which is installed to a casing, such as the casing of a camera, a mobile phone or a video camera. The metallic linkage-type keying device of the present invention comprises: a metallic linkage, having at least two joining portions; and at least one key, having at least two assembling portions. The key is installed to the metallic linkage via fixing two assembling portions to two joining portions. The metallic linkage-type keying device provided by the present invention can prevent ESD from attacking the interior of the casing via key gaps and has the advantages of compactness and low cost.

8 Claims, 4 Drawing Sheets

METALLIC LINKAGE-TYPE KEYING DEVICE

BACKGROUND OF THE INVENTION

1. Field of the Invention

The present invention relates to a linkage-type keying device, particularly to a metallic linkage-type keying device.

2. Description of the Related Art

ESD (Electro Static Discharge) is usually the source of the electrical overstress, which damages electronic elements or systems. ESD usually causes external damages in semiconductor elements and disables electronic products.

ESD is likely to hit the interior of electronic products via penetrating through the assemblage gaps of electronic products. In a camera, the keys thereof are usually the gap-forming locations. The conventional keying device is often a one-piece design having a plastic linkage and plastic keys. In order to prevent the attack of ESD that penetrates through the gaps around keys, metallic plates are disposed in the perimeter of keys to guide ESD to the ground lest ESD attack the interior of electronic products. Refer to FIG. 1(*a*) and FIG. 1(*b*) sectional views schematically showing that metallic plates are disposed in the perimeter of a keying device of a camera. There are two methods to dispose metallic plates 4 in the perimeter of a key 10. One is to dispose the metallic plates 4 between a plastic linkage 6 and a camera casing 8, as shown in FIG. 1(*a*). The other is to dispose the metallic plate 4 at the bottom of the plastic linkage 6, as shown in FIG. 1(*b*). In addition to the plastic linkage 6, which is thicker originally, the installation of the metallic plates 4 makes the conventional keying device 2 occupy more space; thus, not only the camera needs a larger volume, but also the keys 10 become larger and have higher mold and material costs. Accordingly, the present invention proposes a compact and ESD-proof metallic linkage-type keying device.

SUMMARY OF THE INVENTION

One objective of the present invention is to provide a metallic linkage-type keying device, wherein the plastic keys are assembled to a metallic linkage via a heat fusion method.

Another objective of the present invention is to provide a metallic linkage-type keying device, which can prevent ESD from penetrating through key gaps and entering into the casing of an electronic device.

Further another objective of the present invention is to provide a metallic linkage-type keying device, which has the advantages of compactness and low cost.

The metallic linkage-type keying device of the present invention is installed to a casing, e.g. installed to the casing of a camera, a mobile phone, or a video camera with a heat fusion method. According to one aspect of the present invention, the metallic linkage-type keying device comprises: a metallic linkage, having at least two joining portions; and at least one key, having at least two assembling portions. The key is installed to the metallic linkage via engaging two assembling portions to two joining portions. The key is made of a plastic material. The assembling portions are heat-fusion protuberances, and the joining portions are heat-fusion holes (holes for heat fusion). The key is installed to the metallic linkage via heat-fusing the heat-fusion protuberances at the heat fusion holes. The metallic linkage further has at least one grounding portion, and the metallic linkage is electrically connected to the casing via the grounding portion so that ESD can be guided to the ground.

To enable the objectives, technical contents, characteristics and accomplishments of the present invention to be more easily understood, the embodiments of the present invention is to be described in detail in cooperation with the attached drawings below.

BRIEF DESCRIPTION OF THE DRAWINGS

FIG. 1(*b*) is another sectional view schematically showing that a metallic plate is disposed in the perimeter of a conventional keying device of a camera.

DETAILED DESCRIPTION OF THE INVENTION

The present invention pertains to a design of a metallic linkage-type keying device, wherein plastic keys are directly assembled to a metallic linkage. The present invention may apply to various electronic devices, such as cameras, mobile phones and video cameras. Below, the present invention is to be exemplified with its application in a camera.

Figure 1B:
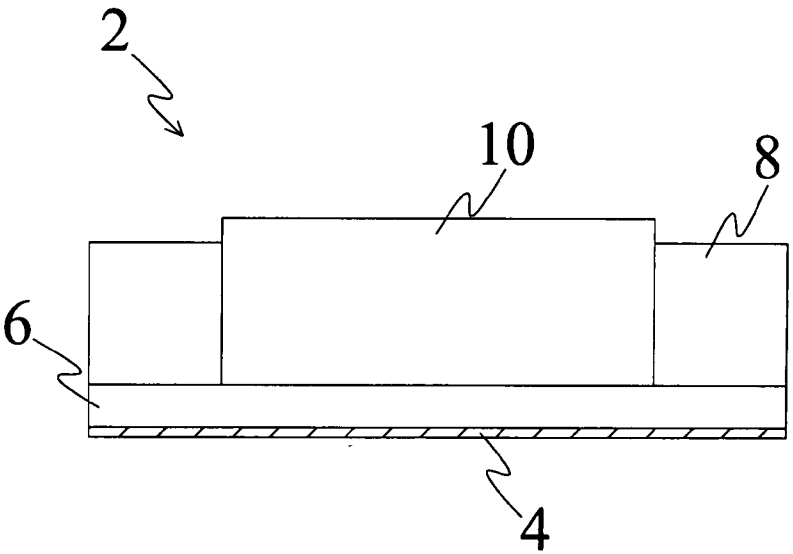
Fig.1(b) (Prior Art)
FIG. 1(*a*) is a sectional view schematically showing that metallic plates are disposed in the perimeter of a conventional keying device of a camera.
Figure 1A:
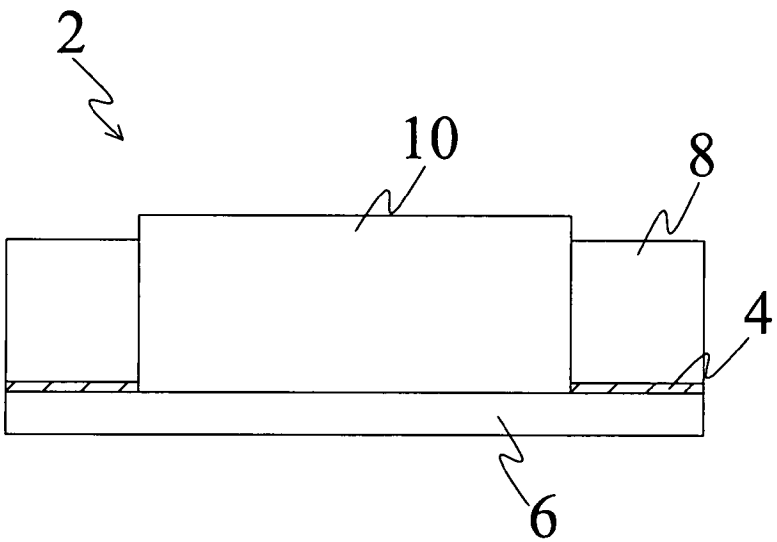
Fig.1(a) (Prior Art)
Figure 2:
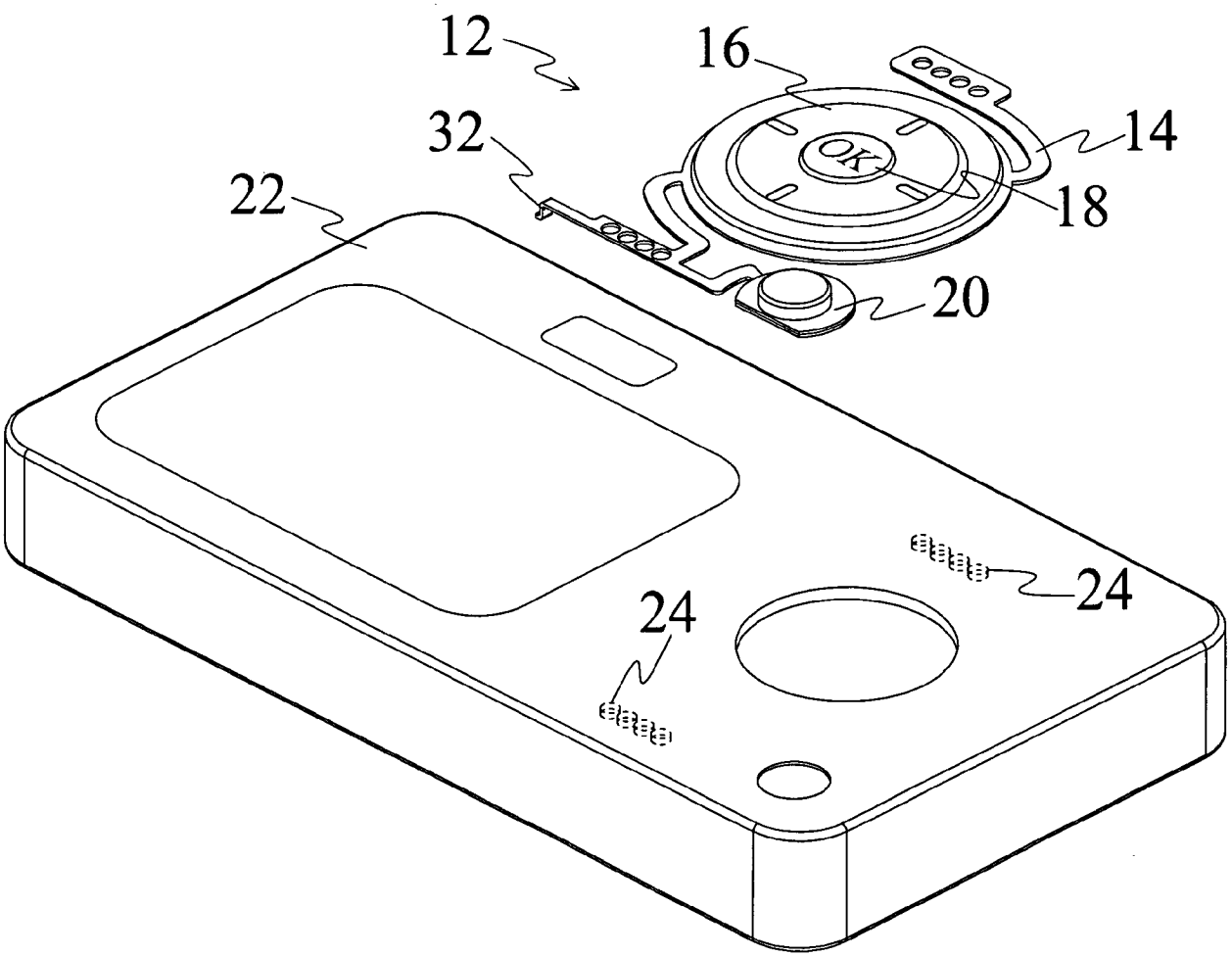
FIG. 2 is a perspective view schematically showing the metallic linkage-type keying device according to the present invention before it is assembled to a camera casing.
Figure 3:
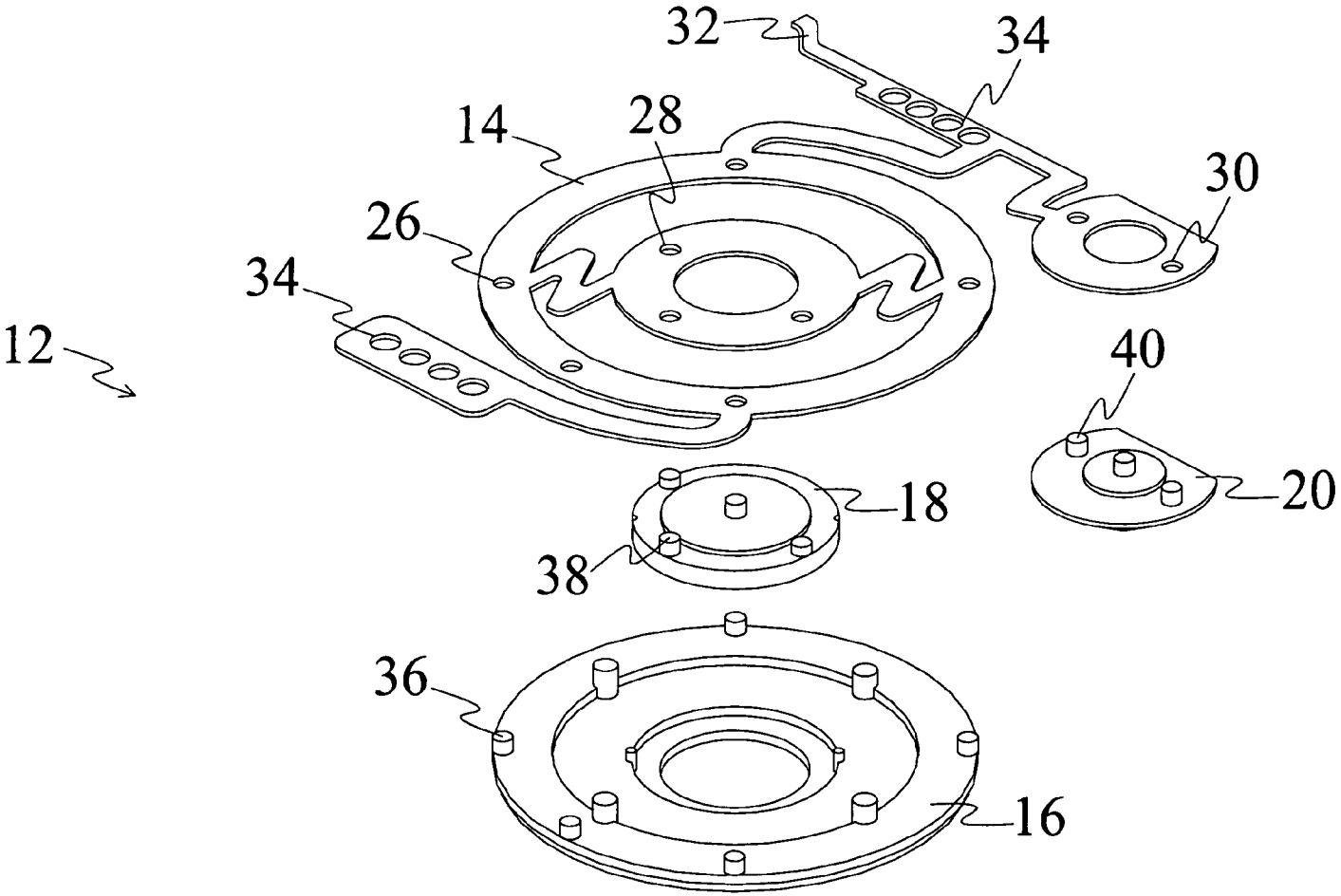
FIG. 3 is an exploded view of the metallic linkage-type keying device according to the present invention.

Refer to FIG. 2 a perspective view schematically showing the metallic linkage-type keying device according to the present invention before it is assembled to a camera casing. As shown in FIG. 2, the metallic linkage-type keying device 12 according to the present invention comprises: a metallic linkage 14; and three keys 16, 18 and 20, made of a plastic material. The camera casing 22 has eight heat-fusion protuberances 24, functioning as connecting portions. Refer to FIG. 3 an exploded view of the metallic linkage-type keying device according to the present invention. As shown in FIG. 3, the metallic linkage 14 has five heat-fusion holes 26, three heat-fusion holes 28, and two heat-fusion holes 30, and all of them function as joining portions. The metallic linkage 14 also has a grounding portion 32, and also has eight fixing portions, such as heat-fusion holes 34, disposed corresponding to the heat-fusion protuberances 24 of the camera casing 22. The bottom of the key 16 has five heat-fusion protuberances 36 disposed corresponding to the heat-fusion holes 26 and functioning as assembling portions. The bottoms of the key 18 and the key 20 respectively have three heat-fusion protuberances 38 and two heat-fusion protuberances 40, which also function as assembling portions. The keys 16, 18 and 20 are installed to the metallic linkage 14 via respectively heat-fusing the heat-fusion protuberances 36, 38 and 40 at the corresponding heat-fusion holes 26, 28 and 30.

Figure 4:
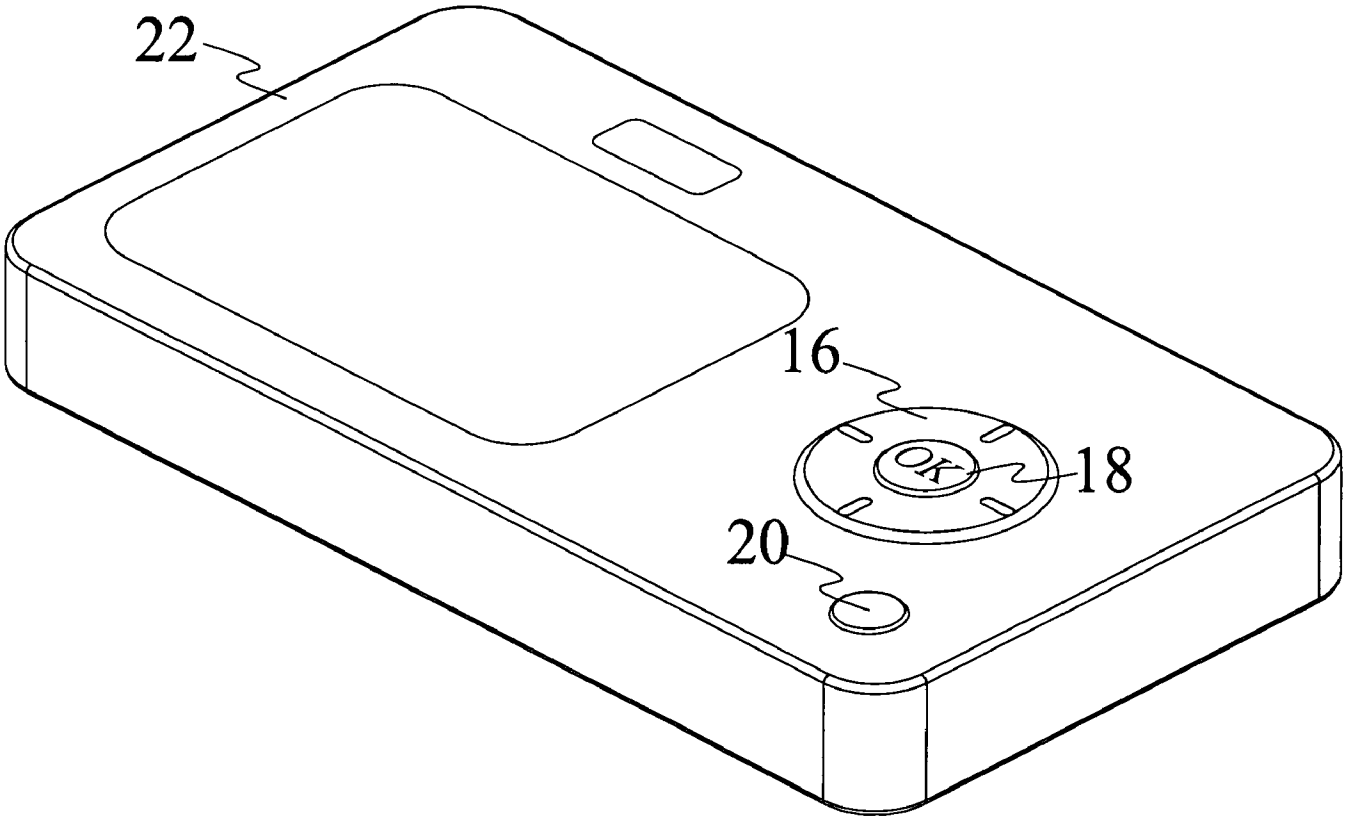
FIG. 4 is a perspective view schematically showing the metallic linkage-type keying device according to the present invention is installed to a camera casing.

Refer to FIG. 2 and FIG. 4. Next, the assemblage of the metallic linkage-type keying device 12 and the camera casing 22 is described. The heat-fusion holes 34 of the metallic linkage 14 are engaged to the heat-fusion protuberances 24 of the camera casing 22 via a heat fusion method; thereby, the metallic linkage-type keying device 12 is assembled to the camera casing 22. Then, the grounding portion 32 of the metallic linkage 14 is electrically connected to a grounding point of the camera casing 22 so that ESD can be guided to the ground via the grounding portion 32.

In the design that the metallic linkage 14 replaces the conventional plastic linkage, none metallic plate needs installing around the keys, and the ESD, which enters into the interior of the camera casing 22 through the gaps of the metallic linkage-type keying device 12, can be guided to the ground via the grounding portion 32 of the metallic linkage 14. In addition to that none metallic plate is installed around the keys, the metallic linkage 14 is thinner than the conventional plastic linkage; therefore, the metallic linkage-type keying device 12 occupies less space than the conventional plastic linkage-type keying device. Further, the keys 16, 18 and 20 can be fabricated to be smaller and simpler; thus, the costs of material and molds are lower for the metallic linkage-type keying device 12.

Those embodiments described above are only to clarify the present invention to enable the persons skilled in the art to understand, make and use the present invention. However, it is not intended to limit the scope of the present invention, and any equivalent modification and variation according to the structures, shapes, characteristics and spirit disclosed in the present invention is to be also included within the scope of the claims of the present invention.

What is claimed is:

1. A metallic linkage-type keying device, installed to a casing of an electronic device, and comprising:

a metallic linkage, having at least two joining portions; and at least one key, having at least two assembling portions, and installed to said metallic linkage via engaging said two assembling portions to said two joining portions.

2. The metallic linkage-type keying device according to claim 1, wherein said electronic device is a camera, a mobile phone, or a video camera.

3. The metallic linkage-type keying device according to claim 1, wherein said joining portions are heat-fusion holes, and said assembling portions are heat-fusion protuberances; said key is installed to said metallic linkage via heat-fusing said heat-fusion protuberances at said heat-fusion holes.

4. The metallic linkage-type keying device according to claim 1, wherein said key is made of a plastic material.

5. The metallic linkage-type keying device according to claim 1, wherein said metallic linkage further comprises a grounding portion, and electro static discharge is guided to the ground via said grounding portion of said metallic linkage.

6. The metallic linkage-type keying device according to claim 1, wherein said metallic linkage has at least two fixing portions, and said casing has at least two connecting portions disposed corresponding to said two fixing portions; said metallic linkage is installed to said casing via engaging said two fixing portions to said two connecting portions.

7. The metallic linkage-type keying device according to claim 6, wherein said fixing portions are heat-fusion holes, and said connecting portions are heat-fusion protuberances; said metallic linkage is installed to said casing via heat-fusing said heat-fusion protuberances at said heat-fusion holes.

8. The metallic linkage-type keying device according to claim 1, wherein said metallic linkage has multiple said joining portions, and said key has multiple said assembling portions; said key is installed to said metallic linkage via engaging said assembling portions to said joining portions.

* * * * *

UNITED STATES PATENT AND TRADEMARK OFFICE

CERTIFICATE OF CORRECTION

PATENT NO. : 7,645,955 B2
APPLICATION NO. : 11/498236
DATED : January 12, 2010
INVENTOR(S) : Huang et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 832 days.

Signed and Sealed this

Twenty-eighth Day of December, 2010

David J. Kappos

David J. Kappos
*Director of the United States Patent and Trademark Office*